United States Patent [19]

Kankaanpää

[11] 4,236,962

[45] Dec. 2, 1980

[54] METHOD AND APPARATUS FOR SEPARATING A WEB FROM A FORMER WIRE AND TRANSFERRING THE WEB TO A PRESS FELT

[75] Inventor: Matti Kankaanpää, Espoo, Finland

[73] Assignee: Valmet Oy, Finland

[21] Appl. No.: 48,602

[22] Filed: Jun. 14, 1979

[30] Foreign Application Priority Data

Jun. 16, 1978 [FI] Finland ..... 781934

[51] Int. Cl.[3] ..... D21F 2/00

[52] U.S. Cl. ..... 162/204; 162/205; 162/306; 162/307; 162/360 R

[58] Field of Search ..... 162/306, 307, 360 R, 162/358, 205, 204

[56] References Cited

U.S. PATENT DOCUMENTS

| | | | |
|---|---|---|---|
| 4,172,759 | 10/1974 | Kankaanpää162 | 306/ |
| 5,576,714 | 4/1971 | Thom et al. | 162/306 |

FOREIGN PATENT DOCUMENTS

| | | | |
|---|---|---|---|
| 558304 | 6/1958 | Canada | 162/306 |
| 1117992 | 11/1961 | Fed. Rep. of Germany | 162/306 |
| 2105091 | 5/1972 | Fed. Rep. of Germany | 162/306 |
| 2716583 | 10/1977 | Fed. Rep. of Germany | 162/306 |
| 46-33724 | 10/1971 | Japan | 162/306 |

*Primary Examiner*—William F. Smith

*Attorney, Agent, or Firm*—Steinberg and Blake

[57] ABSTRACT

In a paper making machine, a method and apparatus for separating the web from the former wire and transferring the same to a transfer felt which preferably comprises a press felt wherein the web is carried by the former wire over a sector of a reverser roll so that it is subjected to a centrifugal force which tends to separate the web from the former wire and wherein the transfer felt is guided so that it engages the web over at least a portion of the sector of the reverser roll lapped by the web carrying former wire. An external suction is applied to the web through the transfer felt in the region of the sector of the reverser roll lapped by the web carrying former wire and engaged transfer felt which subjects the web to a suction force which acts in substantially the same direction as the centrifugal force. The transfer felt laps a grooved suction roll which cooperates with external suction applying apparatus for assisting and maintaining the web adhered to the transfer felt between at least two press nips, the suction applying apparatus communicating with the means for applying the external suction to the web.

9 Claims, 4 Drawing Figures

METHOD AND APPARATUS FOR SEPARATING A WEB FROM A FORMER WIRE AND TRANSFERRING THE WEB TO A PRESS FELT

BACKGROUND OF THE INVENTION

This invention relates generally to methods and apparatus in paper making machines and, more particularly, to methods and apparatus for separating a web from the former wire and for transferring the web to a transfer felt which also comprises a press felt.

The separation of the web from the former wire of a former section of a paper making machine and its transfer to the press section is a critical step in the paper making process since this separation and transfer significantly influences the reliability of the operation of the paper making machine. It is well known that in paper making machines which operate at low speeds, it is possible to use an open draw based upon the difference in speeds of travel of the web carrying former wire and the press felt in the press section.

However, in paper making machines which operate at relatively high speeds or which manufacture thin and consequently low strength paper, it is necessary to use a closed draw in the separation of the web from the former wire and its transfer to the press section. The present invention relates to a method and apparatus for effecting the separation of the web from the former wire and its transfer to the press section of the closed draw type.

Closed draw arrangements for separating the web from the former wire and transferring the same to the press section generally include a transfer fabric or felt belonging to the press section of the paper making machine which is guided into contact with the web carried by the former wire. The transfer felt is urged against the web carried by the former wire such as by a rotating roller whereupon the web adheres to the transfer felt, the latter then carrying the web to the press section.

Generally, there are two types of closed systems for accomplishing the transfer of the web from the former wire to the press section. More particularly, the simpler of these arrangements, commonly termed "lick-up transfer", utilizes a wet transfer felt which contacts the web to "lick-up+ the same, the web adhering to the surface of the transfer felt due to its wet nature. The other type of closed transfer system is generally termed a "vacuum pick-up" system wherein a vacuum ensures the adherence of the web to the transfer felt. A vacuum pick-up system is generally more desirable than a "lick-up" system since the former provides a greater choice in the selection of the quality of the transfer felt, among other things. In this connection and especially in applications where the transfer felt also functions as a press felt, certain requirements must be taken into account in the choice of the felt, namely, the web should securely adhere to the surface of the transfer felt at the point of separation from the former wire while at the same time the transfer felt must function in an efficient manner at a water-removing press roll nip. These requirements, however, are often contradictory in that in order for the web to securely adhere to the felt at the separation and to remain in adherence to the lower surface thereof over a span between the pick-up point and the first press roll nip, the felt must be relatively wet. However, as the moisture content of the felt is increased to facilitate adherence of the web to the felt, the dewatering capabilities, i.e., the absorbency, of the felt is correspondingly decreased therefore rendering the water capacity at the press nip relatively in inefficient. This is a distinct disadvantage in conventional vacuum pick-up arrangements.

Vacuum pick-up systems which utilize separate pick-up suction rolls are known and are widely used in modern paper making machines. For example, such a system is used in a Fourdrinier machine wherein the web is separated from the former wire at a point located on the run of the former wire between the chauffeur roll and the draw roll, the former wire sloping during such run at an angle of about 45° to the horizontal. The particular point at which the web is separated from the former wire and is transferred to the transfer felt is determined by the particular design of the wire and press sections and their mutual location. After the web is separated from the former wire and becomes adhered to the pick-up felt, the web carrying pick-up felt laps the pick-up roll through a sector of about 45°–90° whereupon the web carrying pick-up felt moves onward to the press section.

Such vacuum pick-up systems which utilize separate pick-up suction rolls are disadvantageous in that under certain conditions such, for example, as high speed and inappropriate felts, the change of direction undergone by the web carried by the pick-up felts on the pick-up suction roll causes the web to loosen from the pick-up felt due to the centrifugal forces acting thereon. In order to prevent this separation, the pick-up roll is usually provided with a suction zone that extends beyond the actual zone wherein the web is separated from the former wire. Although this provision insures that the web will be maintained adhered to the felt, the extension of the suction zone requires a corresponding considerable increase in the capacity of the vacuum system for the suction roller. In other words, in such systems the suction requires a greater vacuum capacity than in arrangements where it is only required to separate the web from the wire and attach it to the felt.

Furthermore, conventional suction rolls presently in use in modern large high-speed paper making machines have high energy requirements due to the fact that in addition to handling air passing through the web at the suction roll, the vacuum system must also handle air which passes through the suction roll holes into the suction zone of the roll during each revolution of the suction roll. The quantity of such "hole air" may, in the case of large, high-speed machines, be twice or even three times greater than the quantity of air which passes through the web. In this connection, see applicant's U.S. Pat. No. 4,172,759.

Thus, another significant disadvantage of conventional pick-up systems is the high energy requirements necessitated by the large number of suction rolls utilized therein as well as the high costs of the rolls themselves. Further, such suction rolls are quite noisy in operation.

In order to at least partially alleviate some of the problems discussed above, a stationary transfer suction box has been utilized for separating the web from the former wire rather than a pick-up roll. In this connection, see U.S. Pat. Nos. 3,309,263, 3,441,476, 3,537,955 and 3,528,881.

SUMMARY OF THE INVENTION

Accordingly, one object of the present invention is to provide a new and improved method and apparatus for separating the web from a former wire and transferring the same to a transfer felt.

Another object of the present invention is to provide a new and improved method and apparatus of the type described above wherein the kinetic energy of the web itself as well as centrifugal forces acting thereon are efficiently utilized to assist in the separation of the web from the former wire and to reduce to the greatest extent possible the use of vacuum energy.

Still another object of the present invention is to provide a new and improved method and apparatus as described above wherein the pick-up felt also operates as a press felt and can operate in as dry a condition as possible thereby improving the water removal capability at the press nips.

Yet another object of the present invention is to provide a method and apparatus as described above wherein the web is securely maintained in adherence to the transfer felt from the pick-up point to the first press nip and beyond by means of suction in a manner such that the vacuum capacity required therefor is significantly reduced.

Briefly, in accordance with the present invention, these and other objects are provided by a method and apparatus wherein the web carrying former wire is guided over a relatively wide sector of a reverser roll in a manner such that web is subjected to a centrifugal force which tends to separate the web from the former wire. Simultaneously, the web is subjected to the application of external suction which creates a pressure differential across the web and which results in an additional force acting on the web in substantially the same direction as the centrifugal force. A transfer felt is guided onto the web which is carried by the former wire over the sector of the reverser roll in a manner such that the direction of travel of the transfer felt changes considerably as it travels over the reverser roll. While the web is sandwiched between the former wire and transfer felt on the reverser roll sector, the web is subjected to the external suction action through the transfer felt by means of a suction device. The suction device sealingly engages such, for example, by means of sealing strips provided thereon, the surface of the transfer felt which does not engage the web to subject the latter to the external suction force.

An important feature of the method of the present invention is that the web is separated from the former wire during its run over the reverser roll during which time the direction of the web carrying former wire is substantially changed while, simultaneously, the web is subjected to an external suction action which sets up a force on the web having a direction which is substantially the same as the direction of the centrifugal force acting on the web.

In order to maximize the suction and consequently the pressure differential which acts on the web, the reverser roll preferably comprises a grooved-surface roll having a solid mantle although a roll having a perforated mantle can also be utilized in this connection. Furthermore, it is also desirable that the web be continuously subjected to uninterrupted suction throughout the transfer felt which tends to maintain the web adhered thereto even after the web has separated from the former wire and become adhered to the felt.

It should be understood that the term "substantial change in direction" as used herein depends on various factors including the diameter of the reverser roll and the speed of operation of the paper making machine. Thus, if the machine speed is high, even a small change in direction of the web may be substantial in that large anough centrifugal forces are created to effect the separation of the web from the former wire. Conversely, at a given speed of operation of a paper making machine, the smaller the diameter of the roll lapped by the web carrying former wire, the higher will be the centrifugal force acting on the web since the centrifugal force acting on the web is inversely proportional to the diameter of the roll lapped thereby.

DESCRIPTION OF THE DRAWINGS

A more complete appreciation of the present invention and many of the attendant advantages thereof will be readily appreciated as the same becomes better understood by reference to the following detailed description when considered in connection with the accompanying in which.

DESCRIPTION OF THE PREFERRED EMBODIMENTS

Figure 1:
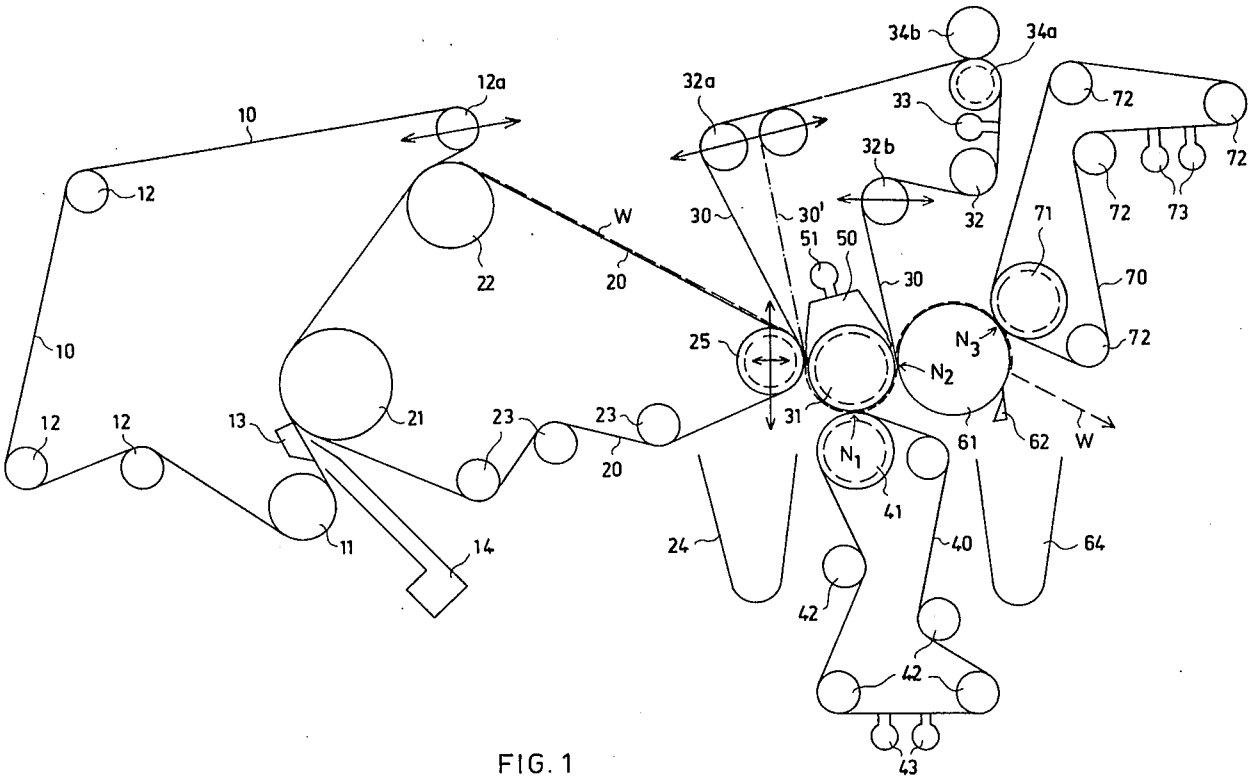
FIG. 1 is a diagramatic side view of the former and press sections of a paper making machine in which the method and apparatus of the present invention are utilized.

Referring now to the drawings wherein like reference characters designate identical or corresponding parts throughout the several views and, more particularly, to FIG. 1, a double-wire forming section and the associated press section of a paper making machine are illustrated. The web forming section comprises an endless covering wire loop 10 and a cooperating endless supporting wire loop 20.

The endless covering wire loop 10 is guided by a chest roll 11 and guide rolls 12 which determine the direction of travel and tension in the covering wire 10. A head box 14 deposits pulp stock on the covering wire 10 and a wire table device 13, known per se, supports the covering wire 10 in the area where the pulp stock is deposited thereon.

The endless supporting wire loop 20 laps a former roll 21 and chauffeur roll 22 which are mutually located with respect to each other in a manner known in the art. The direction of travel and the tension of the supporting wire 20 is adjustably controlled by guide rolls 23.

The supporting wire 20 laps a reverser roll 25 which preferably comprises a grooved roll and a so-called wire pit 24 is located beneath the former section in the vicinity of the reverser roll 25 for receiving wet reject created furing the start-up phase of the paper making machine.

Still referring to FIG. 1, the press section of the paper making machine comprises a suction roll 31, water-receiving press rolls 41, 71, both of the latter preferably having grooved surfaces, and a smooth-surfaced roll 61, preferably comprising a stone roll, provided with a doctor blade 62. A reject pit 64 is located beneath the doctor blade 62, i.e., in the region where the web is separated from the smooth-surfaced roll 61 after the pressing operations.

The press rolls 31, 41 and 71 are each located within respective felt loops 30, 40 and 70. A first water-removing press nip $N_1$ is defined between rolls 31 and 41, a second press nip $N_2$ being defined between rolls 31 and 61, while a third press nip $N_3$ is defined between rolls 61 and 71. Guide and tension adjusting rolls for felt loops 30, 40, 70 are designated 32, 42 and 72 respectively. A guide roll **32*a* is located within felt loop 30, guide roll 32*a* being adjustable in position as indicated by the arrow drawn through it FIG. 1 so that the direction of travel of felt 30 can be adjusted as desired. Devices for maintaining felts 30, 40 and 70 are designated 33, 43 and 73, respectively. Further, a washing press for felt loop 30 is defined by a pair of rolls 34*a*, 34*b***. In general, the construction of the press section of the paper making machine is conventional. For example, the supporting structure, loading equipment and water collecting troughs are entirely conventional and for the sake of clarity, such conventional apparatus have not been shown since they do not directly pertain to the present invention.

Figure 2:
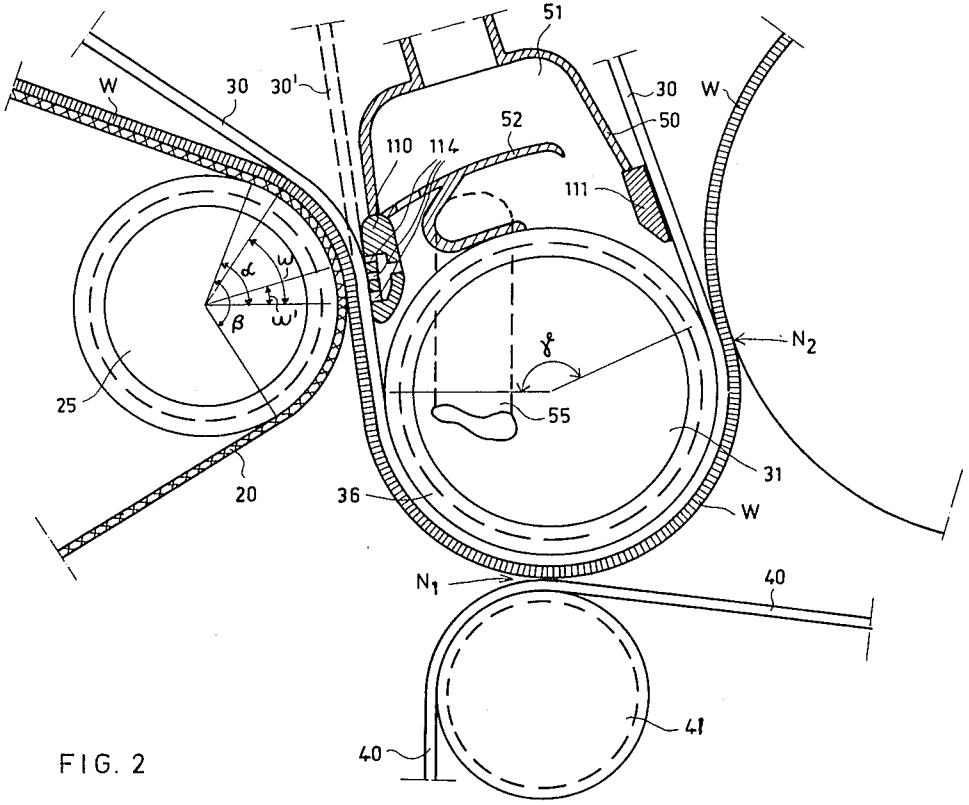
FIG. 2 is a diagramatic detail view of apparatus illustrated in FIG. 1 for separating the web from the former wire and transferring the same to the transfer felt according to the method of the present invention, also illustrating additional press structure.

Referring now to FIG. 2, the web W is separated from the supporting or former wire 20 by means of guiding the same over a sector of reverser roll 25. More particularly, the former wire 20 laps the reverser roll 25 over a sector $\beta$, the web being carried thereby over a sector $\alpha$. Thus, the web carried by the former wire 20 undergoes a substantial change in direction over the sector $\alpha$ whereupon the web is subjected to a centrifugal force created by this change in direction which acts on web W in a manner which tends to separate the same from wire 20.

The felt 30 which, in the present invention, functions as a transfer felt, is directed into engagement with the web W over a sector $\omega$ on reverser roll 25. Thus, it is apparent that over sector $\omega$, the former wire 20, the web W and the felt 30 together comprise a sandwich structure. The extent of sector $\omega$ can be varied by varying the position of guide roll **30*a* (FIG. 1), the extreme positions of felt 30 being indicated by the solid and broken line 30, 30' in FIGS. 1 and 2. Thus, when guide roll 32*a* is in its leftmost position as seen in FIG. 1, the felt 30 illustrated by the solid lines in FIGS. 1 and 2, the extent of the sector $\omega$ over which the sandwich structure described above travels approximately equals the extent of the sector $\alpha$ over which the web W changes direction. Further, as indicated by the arrows in FIG. 1, the position of the reverser roll 25** can be adjusted both vertically and horizontally.

Still referring to FIG. 2, the suction roll 31 comprises a roll whose surface is preferably formed with grooves which extend parallel to the circumference thereof, the mantle of suction roll 31 otherwise being solid and nonperforated. An external suction chamber 50 which is connected to the vacuum system of the paper making machine acts over the sector $\gamma$ of suction roll 31 which is not covered by felt 30 so that a vacuum is created in the cirferentially extending grooves formed in roll 31. A more detailed description of such an arrangement is disclosed in applicant's Finnish patent application 762,620.

The external suction chamber 50 is provided with internal sealing strips 110 and 111 which extend in the cross-machine direction substantially parallel to the axis of roll 31, strips 110 and 111 bearing against the inner surface of felt 30. A preferred embodiment of the sealing strip 110 is illustrated in FIG. 4 and comprises a multi-component shoe 100 which has the dual function of both a suction device which facilitates the separation of the web from former wire 20 and as a sealing device which insures the application of suction through the grooves of the suction roll 31 onto the web W carried by felt 30 to maintain the web W adhered to the felt 30.

Figure 4:
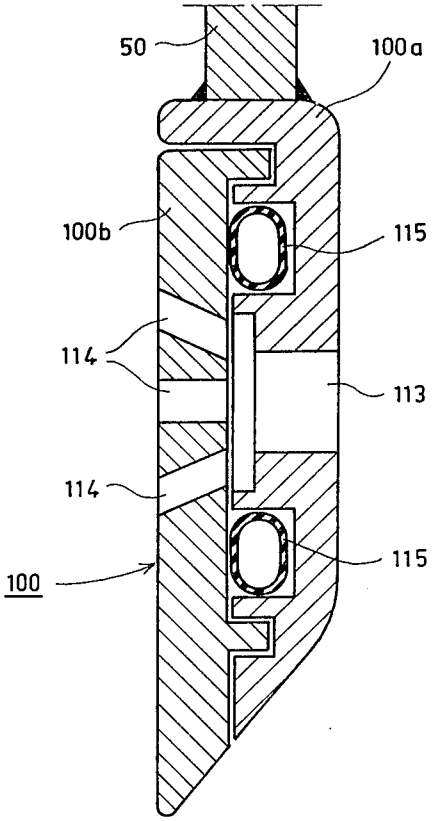
FIG. 4 is a side view in section of a vacuum device utilized in connection with the apparatus of the present invention.

Still referring to FIG. 2, the sealing strip 110 (which comprises the combined sealing and suction device 100 illustrated in FIG. 4) bears against the inner surface of felt 30, the latter separating the sealing strip 110 from the web W over the sector $\omega'$ on reverser roll 25. The sealing strip 110 extends over substantially the entire cross-machine width of the web W and preferably has formed therein a plurality of slots or openings 114 which communicate with the vacuum space 51 of the external suction chamber 50. In this manner, substantially the same suction action which acts on the web as the same laps the suction roll 31 also acts through slots 114 of sealing strip 110 on the web W as it laps over the sector $\omega'$ of reverser roll 25.

A combined splash protection shield and doctor blade device 52 is provided within external suction chamber 50, the shield and doctor blade device 52 acting to collect water which is transferred in press nips $N_1$ and $N_2$ into the grooves of suction roll 31 as well as for directing water away from the suction roll after nip $N_2$. A drain pipe 55 communicates with the shield and doctor blade device 52 for leading the collected water to suitable collection means (not shown).

External suction chamber 50 is mounted on the frame structure of the press section of the paper making machine in a known manner such that its position is selectively adjustable with respect to both the grooved suction roll 31 and reverser roll 25. The direction of felt 30 subsequent to press nip $N_2$ is adjustable by means of the felt guide roll **32*b* and the latter is so positioned as to urge felt 30 into sealing engagement with sealing strip 11 of suction chamber 50**.

Referring now to FIG. 4 a preferred embodiment of the sealing strip 110 is illustrated and constitutes the combined sealing and suction device 100. Device 100 comprises a frame member **100*a* which is welded to the side wall of suction chamber 50 and a sealing component 100*b* interfitted therewith by means of a pair of laterally extending flanges which are received within corresponding grooves formed in the frame member 100*a*. Sealing component 100*b* has a plurality of suction slots 114 formed therethrough which communicate at their inner ends with a suction slot 113 formed in frame member 100*a*, the latter opening into suction space 51 of suction chamber 50. A pair of flexible hoses 115 formed of rubber or other flexible material are located in respective channels formed in the frame member 100*a* in a manner such that side wall portions thereof bear against the inner side surface of sealing component 100*b*. By selectively pressurizing hoses 115, such as hydraulically or pneumatically, the sealing component 100*b* is urged into sealing engagement with the inner surface of felt 30** with an adjustable force.

It will be seen that subsequent to web W separating from the former wire 20 and being transferred onto the outer surface of felt 30, the web carrying felt 30 engages the surface of suction roll 31 at a point and that during the run of the web carrying felt between the point of separation of the web from the former wire and the point of engagement with the suction roll 31, suction acts through felt 30 on web W insuring a reliable adherence of the web W to felt 30 between the point of separation from the former wire to the point of engagement of the web carrying felt 30 with the suction roll 31.

The operation of the wire and press sections of the paper making machine will now be described with reference to FIGS. 1 and 2. Head box 14 feeds a pulp suspension between the covering and supporting wires 10 and 20 whereupon water is removed from the pulp suspension to some extent at the wire table 13 and to a greater extent at former roll 21. The web W is carried between the supporting and covering wires to chauffeur roll 22 wherein additional water is removed, the web W remaining adhered to the supporting wire which carries the web to reverser roll 25. The transfer felt 30, which also comprises the first felt of the press section, is guided into engagement with web W over the sector $\omega$ of reverser roll 25 whereupon web W separates from the former wire 20 and adheres to transfer felt 30.

Since the reverser roll 25 and suction roll 31 are spaced from each other, it is possible to guide web W with conventional drop-off jets (not shown) during the initial start-up phase of the paper making machine to follow the former wire 20 to the wire pit 24.

The separation of web W from the former wire 20 and its transfer and adherence to the felt 30 is primarily accomplished by means of the pressure differential created over the sector $\omega'$ of reverser roll 25 by means of the combined sealing and suction device 100. More particularly, the sealing and suction device 100 bears against the inside surface of felt 30 and transmits suction to the web through this felt over the sector $\omega'$, the suction forces constituting the primary means by which the web W is separated from the former wire 20. However, the separation of the web W from wire 20 is further facilitated by the centrifugal force acting on the web W over the sector $\alpha$, i.e., as the web carrying wire 20 changes direction prior to suction being applied.

Separation of the web from the former wire can also be further promoted by forming the roll 25 with a perforated mantle and providing a positive pressure at the interior of roll 25 by means of a blower device or the like such for example as shown in applicant's U.S. Patent Application Ser. No. 787,334, U.S. Pat. No. 4,113,557.

Thus, the web W is transferred to felt 30 and adheres thereto primarily due to the suction effect to which the web is subjected through felt 30 in the region of suction roll 31.

The web carrying felt 30 travels over the surface of suction roll 31 to the first press nip $N_1$ where dewatering takes place simultaneously towards both the suction roll 31 and the grooved roll 41. The web W remains adhered to the transfer felt 30 subsequent to the first press nip $N_1$ due to the suction provided by suction chamber 51 which is transmitted to the circumferentially extending grooves formed in suction roll 31.

The web carrying transfer felt 30 travels to the second press nip $N_1$ whereafter the web W separates from felt 30 and adheres to the surface of the smooth-surfaced roll 61 and is transported to the third press nip $N_3$. After this third press nip, the web W is removed from the surface of roll 61 in a conventional manner such, for example, as by means of a speed differential and is thereafter conducted to the dryer section of the paper making machine. Should the web rupture or similar problem arise, the web can be separated from the surface of the roll 61 by means of doctor blade 62 and passed to the reject pit 64.

The method and apparatus of the present invention whereby the web is transferred from the former to the press felt has the significant advantage relative to conventional web transfer arrangements in that the transfer felt 30 which also functions as the first press felt can operate in a relatively dry state since the adherence of web W on the surface of felt 30 is not directly dependent upon water film adhesion. Further, the adherence of web W to felt 30 as the same is carried over the sector of grooved suction roll 31 is not based on water film adhesion since web W is subjected to suction during such travel. The fact that felt 30 operates under dry conditions results in a considerable improvement in the water removal capacity at the press nips $N_1$ and $N_2$.

Since felt 30 can operate under relatively dry conditions, it is equipped with felt maintenance and pressing equipment 33, 34. The particular felt utilized for felt 30 may be chosen with primary emphasis being given to the pressing process since the adhesion properties of this felt are secondary.

Figure 3:
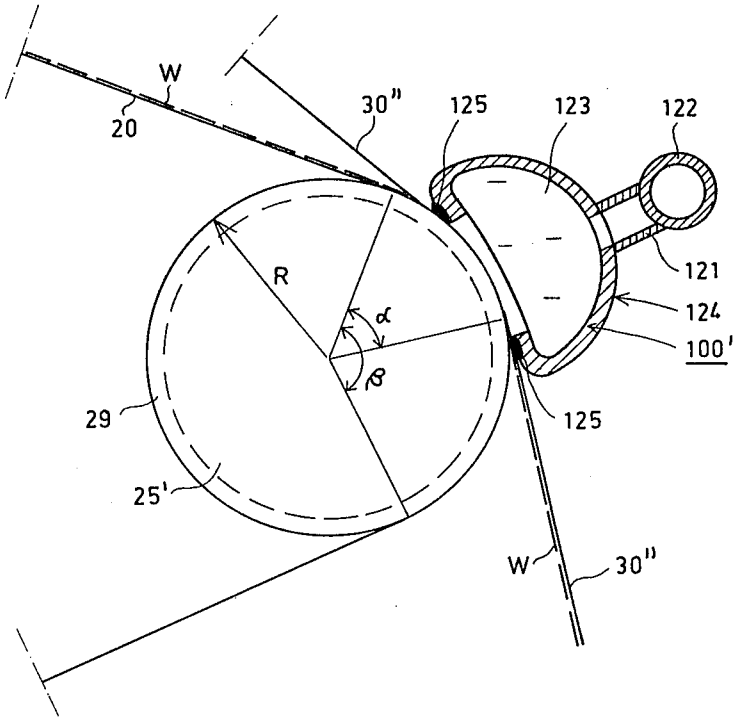
FIG. 3 is a diagramatic side view illustrating a general form of the vacuum and roll structure of the apparatus of the present invention for performing the method of the present invention.

Referring to FIG. 3, the apparatus of the present invention is shown in generalized form. More particularly, the former wire 20 laps the reverser roll 25' over a sector $\beta$. The web W supported by former wire 20 undergoes achange in direction on reverser roll 25' over the sector $\alpha$ and is transferred at a point on this sector to felt 30''. The transfer of the web W from wire 20 to felt 30'' is effected by both the centrifugal force created by the change in direction undergone by the web W and by the pressure differential created by the suction shoe device 100', the latter comprising a suction chamber 124 whose interior 123 is connected by pipe 121 to a pipe 122 which leads to the vacuum pump. The suction chamber 124 defines a relatively broad suction sector bordered by sealing strips 125 which bear against the inside surface of felt 30''. The sealing strips 125 may be suitably adjusted so that the direction of felt 30'' deviates under their influence to a minor extent so that strips 125 do not cause any significant wear on felt 30''. Thus, at a point on sector $\alpha$, the web W separates from former wire 20 and moves onto the felt 30'' and the adherence of web W on the outer surface of felt 30'' is insured by subjecting the web W to suction from the suction box 123 by virtue of the suction sector thereof extending to some extent over the straight run of the web carrying felt 30''. The web W, having been transferred to felt 30'' at a region adjacent to suction chamber 124, moves to the next phase of the paper making procedure such, for example, as to the press part of the paper machine.

An important advantage of the present invention is that several different parameters may be varied either alone or in combination with each other to provide more optimum separation and transfer of the web from the former wire to the felt. Thus, in addition to the speed of travel of web W and its moisture content at the point of separation and transfer, such parameters include the radius of reverser roll 25, the widths of sectors $\alpha$, $\beta$, and $\omega$ both in absolute value and relative to each other. These parameters may be varied over relatively wide limits so as to provide optimal separation and transference of the web.

It should be noted that the method and apparatus of the present invention is not limited to the particular former arrangement illustrated in FIG. 1. For example, the present invention may be utilized in connection with single wire Fourdrinier wire sections wherein the reverser roll is located approximate to the suction roll of the press section. Further, the construction of the press section of the paper making machine need not be as particularly shown in the figures. Thus, for example, the third press nip may be defined by a separate set of press rolls.

Obvious, numerous modifications and variations of the present invention are possible in the light of the above teachings. It is therefore to be understood that within the scope of the claims, the invention may be practiced otherwise than is specifically disclosed herein.

What is claimed is:

1. A method for separating a web from a former wire of a former section of a paper making machine and transferring the same to a transfer felt which also functions as a press felt, comprising the steps of:

guiding the web carrying former wire over a first sector of a reverser roll so that the web is subjected to a centrifugal force over the first sector which tends to separate the web from the former wire;

guiding the transfer felt so that a surface thereof engages the web over at least a portion of the first sector of the reverser roll such that the transfer felt changes direction over a substantial angle while in contact with the web as the same travels on the reverser roll;

applying external suction to the web through the transfer felt over at least a portion of said first sector of the reverser roll for creating a pressure differential across the web to subject the same to a force acting in substantially the same direction as the centrifugal force, said suction being applied to the web by a vacuum device located in the area of the reverser roll, said device being provided with sealing strips which sealingly engage the surface of the transfer felt which does not engage the web;

whereby the web separates from the former wire at a point on the first sector of the reverser roll and is transferred and adheres to the transfer felt;

guiding the transfer felt around a sector of a grooved press roll substantially immediately after the web is transferred from the wire to the felt under the combined action of the centrifual and suction forces acting thereon; and subjecting the grooved press roll to external suction in a manner such that the suction is applied through the grooves of the press roll to the web.

2. The method as recited in claim 1 including the further steps of guiding the web over the surface of the grooved press roll through two press nips defined by second and third press rolls in nip defining relationship with said grooved roll, and supporting the web on the surface of the grooved press roll between the two press nips under the action of the external suction applied to the grooved press roll.

3. In a paper making machine, apparatus for separating a web from a former wire of a former section of said machine and transferring the same through a transfer felt, which also functions as a press felt, comprising:

a web carrying former wire which laps a reverser roll over a first sector so that the web carried by the former wire undergoes a change in direction over said first sector thereby subjecting the web to a centrifugal force over said first sector which tends to separate the web from the former wire;

a transfer felt having a portion which engages the web over at least a portion of said first sector of said reverser roll so that the transfer felt changes direction while in contact with the web as the same travels on the reverser roll;

means for externally applying suction to said web through said transfer felt over at least a portion of said first sector of said reverser roll to create a force due to the resulting pressure differential across said web, which force acts in substantially the same direction as the centrifugal force, said suction means comprising a vacuum device located in the area of said reverser roll, said vacuum device being provided with sealing strips which sealingly engage the surface of said transfer felt which does not engage the web, said vacuum device including a suction shoe having at least one suction opening which is arranged adjacent to the portion of the felt which engages said reverser roll;

whereby the web separates from the former wire at a point on said first sector of said reverser roll and is transferred and adheres to said transfer felt;

a grooved suction roll lapped by said transfer felt;

an external suction box communicating with said grooved suction roll creating a suction within the grooves thereof;

a first press nip defined by said grooved suction roll and a grooved press roll, said grooved press roll being lapped by a press felt; and a second press nip defined by said groove suction roll and a smooth-surfaced press roll.

4. The combination of claim 3 wherein said suction shoe is located so as to form an extension of said external suction box and to define a transfer nip with said reverser roll.

5. The combination of claim 4 wherein said at least one suction opening formed in said suction shoe communicates with the interior of said external suction box.

6. The combination of claim 5 wherein said suction shoe includes a member which elastically bears against said portion of said transfer felt which engages said web on said reverser roll on the surface thereof which does not engage said web.

7. The combination of claim 6 wherein said suction shoe further includes means for selectively adjusting the pressure exerted by such shoe member on said transfer felt portion.

8. The combination of claim 7 wherein said pressure adjusting means comprises a flexible hose located adjacent to said shoe member.

9. A method of separating a web from a former wire of a former section of a paper making machine and transferring the same to a transfer felt which preferably comprises a press felt, comprising the steps of:

guiding the web carrying former wire over a first sector of a reverser roll wherein the direction of travel of the web carrying wire substantially changes so that the web while being carried by the wire over said first sector is subjected to a centrifugal force over the first sector which tends to separate the web from the former wire;

guiding the transfer felt so that a surface thereof engages the web over at least a portion of the first sector of the reverser roll such that the transfer felt changes direction over a substantial angle while in contact with the web as the same travels on the reverser roll and wherein upon guiding the transfer felt into engagement with the web, a sandwich structure comprising the former wire, the web and the transfer felt is formed, the sandwich structure extending over a second sector of said reverser roll contained within said first sector thereof;

pressing the transfer felt against the web over a third sector of the reverser roll by means of a shoe device;

applying external suction to the web through the transfer felt over said third sector of the reverser roll through openings formed in the shoe device, for creating a pressure differential across the web to subject the same to a force acting in substantially the same direction as the centrifugal force, said shoe device being provided with sealing strips which sealingly engage the surface of the transfer felt which does not engage the web;

whereby the web separates from the former wire at a point on the first sector of the reverser roll and is transferred and adheres to the transfer felt;

guiding the web carrying transfer felt subsequent to the point of separation of the web from the wire to a first press nip defined by a suction press roll and a grooved roll, the latter operating within its own press felt so that water is removed from the web at the first press nip towards both the suction and grooved rolls; and guiding the web transfer felt on the suction roll surface from the first press nip to a second press nip defined by the suction press roll and a smooth-surfaced roll, the web being continuously subjected to suction during such travel by the suction press roll and water being removed from the web at the second press nip towards the suction roll; the web then separating from the transfer felt and adhering to and traveling over the surface of the smooth-surfaced roll whereupon it is removed therefrom for further treatment.

* * * * *